US008740050B2

(12) United States Patent
Zinck et al.

(10) Patent No.: US 8,740,050 B2
(45) Date of Patent: Jun. 3, 2014

(54) CARTON WITH LID

(75) Inventors: Becky L. Zinck, Concord, NH (US); Jeffrey T. Wright, Concord, NH (US)

(73) Assignee: Graphic Packaging International, Inc., Marietta, GA (US)

( * ) Notice: Subject to any disclaimer, the term of this patent is extended or adjusted under 35 U.S.C. 154(b) by 190 days.

(21) Appl. No.: 13/311,073

(22) Filed: Dec. 5, 2011

(65) Prior Publication Data

US 2012/0138668 A1 Jun. 7, 2012

Related U.S. Application Data

(60) Provisional application No. 61/459,052, filed on Dec. 6, 2010.

(51) Int. Cl.
*B65D 5/20* (2006.01)
*B65D 5/66* (2006.01)

(52) U.S. Cl.
USPC ..... 229/114; 229/146; 229/906; 229/920; 229/931

(58) Field of Classification Search
USPC ..... 229/906, 920, 930, 931, 114, 146, 229/160.1, 902; 220/4.23
See application file for complete search history.

(56) References Cited

U.S. PATENT DOCUMENTS

| | | | |
|---|---|---|---|
| 1,048,577 | A | 12/1912 | Pardoe |
| 1,656,919 | A | 1/1928 | Marsh |
| 1,793,102 | A | 2/1931 | Labombarde |
| 1,901,483 | A | 3/1933 | Ware, Jr. |
| 1,925,102 | A | 9/1933 | Levkoff |
| 2,027,079 | A | 1/1936 | Weiss |
| 2,054,596 | A | 9/1936 | Ford |
| 2,141,743 | A | 12/1938 | Ethridge |
| 2,145,430 | A | 1/1939 | New |
| 2,152,079 | A | 3/1939 | Mott |
| 2,180,808 | A | 11/1939 | Jacobstein et al. |
| 2,194,220 | A | 3/1940 | Elder |
| 2,835,594 | A | 5/1958 | Felt et al. |
| 2,877,736 | A | 3/1959 | Simmons |
| 2,887,389 | A | 5/1959 | Linville |
| 2,964,231 | A | 12/1960 | Hanselman, Jr. et al. |

(Continued)

FOREIGN PATENT DOCUMENTS

| | | |
|---|---|---|
| DE | 1 586 447 | 4/1970 |
| DE | 2 320 190 | 11/1973 |

(Continued)

*Primary Examiner* — Gary Elkins
*Assistant Examiner* — Scott McNurlen
(74) *Attorney, Agent, or Firm* — Womble Carlyle Sandridge & Rice, LLP

(57) ABSTRACT

A carton for holding a food product can comprise a tray and a lid. The lid can cooperate with the tray to at least partially close the carton. The carton further can comprise a hinge at least partially foldably connecting the lid and the tray. The hinge can comprise a first hinge fold line, a second hinge fold line, and a cut extending between the first hinge fold line and the second hinge fold line. The first hinge fold line and the second hinge fold line are generally aligned along a hinge axis, and the cut comprises a central portion that is generally parallel to the hinge axis and is offset from the hinge axis. Portions of a side panel of the tray are foldably connected to respective portions of a side panel of the lid along the respective first and second hinge fold lines.

21 Claims, 8 Drawing Sheets

(56) References Cited

U.S. PATENT DOCUMENTS

| | | | | | |
|---|---|---|---|---|---|
| 2,990,992 | A | | 7/1961 | Ellis | |
| 3,002,613 | A | | 10/1961 | Merkel | |
| 3,071,882 | A | | 1/1963 | Eisman et al. | |
| 3,099,381 | A | | 7/1963 | Meyers | |
| 3,131,851 | A | | 5/1964 | Pace | |
| 3,131,852 | A | | 5/1964 | Forbes, Jr. | |
| 3,139,979 | A | | 7/1964 | Russell | |
| 3,164,316 | A | | 1/1965 | Wurster et al. | |
| 3,181,772 | A | | 5/1965 | Collins et al. | |
| 3,185,382 | A | | 5/1965 | Nunn | |
| 3,193,175 | A | | 7/1965 | Moreton | |
| 3,205,603 | A | | 9/1965 | Brumley | |
| 3,206,096 | A | | 9/1965 | Struble | |
| 3,206,103 | A | | 9/1965 | Bixler | |
| 3,215,332 | A | | 11/1965 | Bess | |
| 3,228,710 | A | * | 1/1966 | Chodorowski | 281/38 |
| 3,263,900 | A | | 8/1966 | Link et al. | |
| 3,276,665 | A | | 10/1966 | Rasmussen | |
| 3,280,968 | A | | 10/1966 | Craine | |
| 3,310,222 | A | | 3/1967 | Buttery | |
| 3,310,223 | A | | 3/1967 | Buttery | |
| 3,325,081 | A | | 6/1967 | Mahon | |
| 3,409,205 | A | | 11/1968 | Meyers | |
| 3,410,476 | A | | 11/1968 | Buttery | |
| 3,524,581 | A | | 8/1970 | Buttery | |
| 3,596,823 | A | | 8/1971 | Zitzelman | |
| 3,653,495 | A | | 4/1972 | Gray | |
| 3,677,458 | A | | 7/1972 | Gosling | |
| 3,693,865 | A | | 9/1972 | Desmond et al. | |
| 3,734,390 | A | | 5/1973 | Buttery et al. | |
| 3,759,378 | A | | 9/1973 | Werth | |
| 3,786,914 | A | | 1/1974 | Beutler | |
| 3,840,172 | A | | 10/1974 | Zimmermann | |
| 3,884,438 | A | | 5/1975 | Logsdon | |
| 3,958,744 | A | | 5/1976 | Herglotz | |
| 3,981,434 | A | | 9/1976 | Ramich | |
| 4,004,691 | A | | 1/1977 | Wihksne | |
| 4,008,849 | A | | 2/1977 | Baber | |
| 4,046,313 | A | | 9/1977 | Perry | |
| 4,111,297 | A | | 9/1978 | Paulin | |
| 4,113,100 | A | | 9/1978 | Soja | |
| 4,232,816 | A | * | 11/1980 | Johnson et al. | 229/114 |
| 4,266,713 | A | * | 5/1981 | Maroszek | 229/146 |
| 4,271,964 | A | | 6/1981 | Train | |
| 4,289,240 | A | | 9/1981 | Mueller | |
| 4,472,896 | A | | 9/1984 | Brauner et al. | |
| 4,519,538 | A | | 5/1985 | Omichi | |
| 4,558,785 | A | | 12/1985 | Gordon | |
| 4,630,733 | A | | 12/1986 | Fear | |
| 4,669,614 | A | | 6/1987 | Froom | |
| 4,684,023 | A | | 8/1987 | Cortopassi | |
| 4,742,917 | A | | 5/1988 | Bornwasser | |
| 4,749,086 | A | | 6/1988 | Donohie | |
| 4,757,902 | A | | 7/1988 | Hutchinson et al. | |
| 4,773,541 | A | | 9/1988 | Riddell | |
| 4,792,085 | A | * | 12/1988 | Waring et al. | 229/114 |
| 4,793,487 | A | | 12/1988 | Bentsen et al. | |
| 4,815,609 | A | | 3/1989 | Kiedaisch | |
| 4,886,160 | A | | 12/1989 | Kligerman | |
| 4,901,457 | A | | 2/1990 | Chandler | |
| 4,907,698 | A | | 3/1990 | Konrad et al. | |
| 4,913,291 | A | | 4/1990 | Schuster | |
| 4,944,407 | A | | 7/1990 | Thiele et al. | |
| D320,743 | S | | 10/1991 | Alexander et al. | |
| 5,058,803 | A | | 10/1991 | Gulliver | |
| 5,097,958 | A | | 3/1992 | Josephs et al. | |
| RE33,979 | E | * | 6/1992 | Cortopassi | 206/459.1 |
| 5,181,650 | A | | 1/1993 | Hollander et al. | |
| D342,446 | S | | 12/1993 | Parker et al. | |
| D346,552 | S | | 5/1994 | Krupa | |
| 5,330,099 | A | | 7/1994 | Beales et al. | |
| 5,332,147 | A | * | 7/1994 | Sorenson | 229/114 |
| 5,368,194 | A | | 11/1994 | Oliff et al. | |
| 5,388,758 | A | * | 2/1995 | Scovell | 229/146 |
| D365,272 | S | | 12/1995 | Krupa et al. | |
| 5,484,102 | A | | 1/1996 | DeMay | |
| 5,662,265 | A | | 9/1997 | Jensen | |
| 5,690,273 | A | | 11/1997 | Jensen | |
| 5,692,672 | A | * | 12/1997 | Hunt | 229/128 |
| 5,697,549 | A | | 12/1997 | Yocum | |
| 5,699,957 | A | | 12/1997 | Blin et al. | |
| 5,722,583 | A | | 3/1998 | Focke et al. | |
| 5,788,117 | A | | 8/1998 | Zimmanck | |
| 5,826,781 | A | | 10/1998 | Jensen | |
| 5,842,576 | A | | 12/1998 | Snow | |
| 5,857,570 | A | | 1/1999 | Brown | |
| 5,878,947 | A | | 3/1999 | Hoy et al. | |
| 5,881,884 | A | | 3/1999 | Podosek | |
| 5,921,398 | A | | 7/1999 | Carroll | |
| 5,927,498 | A | | 7/1999 | Saam | |
| 5,979,749 | A | | 11/1999 | Bozich | |
| 6,027,018 | A | | 2/2000 | Yocum | |
| 6,041,997 | A | | 3/2000 | Jensen | |
| 6,068,181 | A | | 5/2000 | Cai | |
| 6,092,719 | A | | 7/2000 | Capo | |
| D431,462 | S | | 10/2000 | Menaged et al. | |
| 6,129,211 | A | | 10/2000 | Prakken et al. | |
| 6,135,289 | A | | 10/2000 | Miller | |
| 6,349,875 | B1 | * | 2/2002 | Whitnell | 229/146 |
| 6,386,441 | B2 | * | 5/2002 | Philips | 229/143 |
| D458,127 | S | | 6/2002 | de Groote | |
| D460,691 | S | | 7/2002 | Morris et al. | |
| 6,419,152 | B1 | | 7/2002 | Tokarski | |
| 6,435,351 | B1 | | 8/2002 | Gibb | |
| 6,478,159 | B1 | | 11/2002 | Taylor | |
| 6,481,259 | B1 | * | 11/2002 | Durney | 72/324 |
| D467,499 | S | | 12/2002 | Garza et al. | |
| 6,510,982 | B2 | | 1/2003 | White | |
| 6,523,692 | B2 | | 2/2003 | Gregory | |
| D473,787 | S | | 4/2003 | Jones, Jr. et al. | |
| D484,043 | S | | 12/2003 | Hwang et al. | |
| 6,681,983 | B2 | | 1/2004 | Bill-Moore | |
| 6,834,793 | B2 | | 12/2004 | Sutherland | |
| 6,913,189 | B2 | | 7/2005 | Oliff et al. | |
| 6,913,190 | B2 | | 7/2005 | Ruhbusch et al. | |
| 6,923,365 | B2 | | 8/2005 | Auclair et al. | |
| 7,021,468 | B2 | | 4/2006 | Cargile | |
| 7,225,930 | B2 | | 6/2007 | Ford et al. | |
| 7,328,834 | B2 | | 2/2008 | Harrelson | |
| 7,416,109 | B2 | | 8/2008 | Sutherland | |
| 7,669,755 | B2 | | 3/2010 | Smalley | |
| 7,743,944 | B2 | | 6/2010 | Ho Fung et al. | |
| 7,784,675 | B2 | | 8/2010 | Sutherland et al. | |
| 8,006,893 | B2 | * | 8/2011 | Burke et al. | 229/146 |
| 8,056,799 | B2 | | 11/2011 | Burke et al. | |
| 2001/0001447 | A1 | | 5/2001 | Gregory | |
| 2002/0043554 | A1 | | 4/2002 | White et al. | |
| 2002/0170845 | A1 | | 11/2002 | Oliff | |
| 2003/0047595 | A1 | | 3/2003 | Bill-Moore | |
| 2004/0074953 | A1 | | 4/2004 | Yocum | |
| 2004/0099570 | A1 | | 5/2004 | Cargile | |
| 2005/0092649 | A1 | | 5/2005 | Ford et al. | |
| 2005/0199690 | A1 | | 9/2005 | Peterson | |
| 2006/0243739 | A1 | | 11/2006 | Sherman et al. | |
| 2006/0266815 | A1 | | 11/2006 | Coltri-Johnson et al. | |
| 2007/0000934 | A1 | | 1/2007 | Wolpow | |
| 2007/0108262 | A1 | * | 5/2007 | D'Amato | 229/146 |
| 2007/0267467 | A1 | | 11/2007 | Burke et al. | |

FOREIGN PATENT DOCUMENTS

| | | | |
|---|---|---|---|
| EP | 0 704 386 | A1 | 4/1996 |
| FR | 1 379 931 | | 12/1963 |
| GB | 13 1 218 016 | | 1/1971 |
| GB | 2 321 237 | A | 7/1998 |
| JP | S52-039054 | | 3/1952 |
| JP | S52-096178 | | 8/1977 |
| JP | S54-079106 | | 6/1979 |
| JP | H06-87221 | | 12/1994 |
| JP | H7-28016 | | 5/1995 |
| JP | H08-113246 | | 5/1996 |
| JP | 2002-87427 | | 3/2002 |
| WO | WO 92/06896 | | 4/1992 |
| WO | WO 98/31593 | | 7/1998 |

(56) References Cited

FOREIGN PATENT DOCUMENTS

| | | | |
|---|---|---|---|
| WO | WO 03/082686 | A1 | 10/2003 |
| WO | WO 2004/063031 | A1 | 7/2004 |
| WO | WO 2005/110866 | A1 | 11/2005 |
| WO | WO 2006/073506 | A1 | 7/2006 |

* cited by examiner

CARTON WITH LID

CROSS-REFERENCE TO RELATED APPLICATIONS

This application claims the benefit of U.S. Provisional Patent Application No. 61/459,052, filed Dec. 6, 2010.

INCORPORATION BY REFERENCE

The disclosure of U.S. Provisional Patent Application No. 61/459,052, which was filed on Dec. 6, 2010, is hereby incorporated by reference for all purposes as if presented herein in its entirety.

BACKGROUND OF THE DISCLOSURE

The present disclosure relates to the cartons and/or packages for holding food products or other items.

SUMMARY OF THE DISCLOSURE

In general, one aspect of the disclosure is generally directed to a carton for holding a product. The carton can comprise a tray comprising a plurality of tray panels that extend at least partially around an interior of the tray. The plurality of tray panels can comprise a bottom panel and at least one tray side panel foldably connected to the bottom panel, and the at least one tray side panel can comprise a tray hinge side panel. The carton also can comprise a lid comprising a plurality of lid panels that extend at least partially around an interior of the lid. The plurality of lid panels comprises a top panel and at least one lid side panel foldably connected to the top panel. The at least one lid side panel can comprise a lid hinge side panel, and the lid can cooperate with the tray to at least partially close the carton when the carton is configured in a closed position. The carton further can comprise a hinge at least partially foldably connecting the lid and the tray. The hinge can comprise a first hinge fold line, a second hinge fold line, and a cut extending between the first hinge fold line and the second hinge fold line. The first hinge fold line and the second hinge fold line are generally aligned along a hinge axis, and the cut comprises a central portion that is generally parallel to the hinge axis and is offset from the hinge axis. A first portion of the tray hinge side panel is foldably connected to a first portion of the lid hinge side panel along the first hinge fold line, and a second portion of the tray hinge side panel is foldably connected to a second portion of the lid hinge side panel along the second hinge fold line.

In another aspect, the disclosure is generally directed to a blank for forming a carton. The blank can comprise a tray portion for forming a tray in the carton formed from the blank. The tray portion can comprise a plurality of tray panels comprising a bottom panel and at least one tray side panel foldably connected to the bottom panel, and the at least one tray side panel can comprise a tray hinge side panel. The blank further can comprise a lid portion for forming a lid in the carton formed from the blank. The lid portion can comprise a plurality of lid panels comprising a top panel and at least one lid side panel foldably connected to the top panel, and the at least one lid side panel can comprise a lid hinge side panel. The carton also can comprise hinge features for forming a hinge at least partially foldably connecting the lid and the tray in the carton formed from the blank. The hinge features can comprise a first hinge fold line, a second hinge fold line, and a cut extending between the first hinge fold line and the second hinge fold line. The first hinge fold line and the second hinge fold line are generally aligned along a hinge axis, and the cut comprises a central portion that is generally parallel to the hinge axis and is offset from the hinge axis. A first portion of the tray hinge side panel is foldably connected to a first portion of the lid hinge side panel along the first hinge fold line, and a second portion of the tray hinge side panel is foldably connected to a second portion of the lid hinge side panel along the second hinge fold line.

In another aspect, the disclosure is generally directed to a method of forming a carton. The method can comprise obtaining a blank comprising a tray portion, a lid portion, and hinge features. The tray portion can comprise a plurality of tray panels comprising a bottom panel and at least one tray side panel foldably connected to the bottom panel. The at least one tray side panel can comprise a tray hinge side panel. The lid portion can comprise a plurality of lid panels comprising a top panel and at least one lid side panel foldably connected to the top panel. The at least one lid side panel can comprise a lid hinge side panel, and the hinge features comprise a first hinge fold line, a second hinge fold line, and a cut extending between the first hinge fold line and the second hinge fold line. The first hinge fold line and the second hinge fold line are generally aligned along a hinge axis, and the cut comprises a central portion that is generally parallel to the hinge axis and is offset from the hinge axis. A first portion of the tray hinge side panel is foldably connected to a first portion of the lid hinge side panel along the first hinge fold line, and a second portion of the tray hinge side panel is foldably connected to a second portion of the lid hinge side panel along the second hinge fold line. The method further can comprise forming an interior of a tray by folding the at least one tray side panel relative to the bottom panel, and forming an interior of a lid by folding the at least one lid side panel relative to the top panel. The lid can be foldably connected to the tray at a hinge that comprises the hinge features. The method also can comprise positioning the lid and the tray between an open configuration and a closed configuration by folding the lid relative to the tray at the hinge.

Those skilled in the art will appreciate the above stated advantages and other advantages and benefits of various additional embodiments reading the following detailed description of the embodiments with reference to the below-listed drawing figures.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

Figure 1:
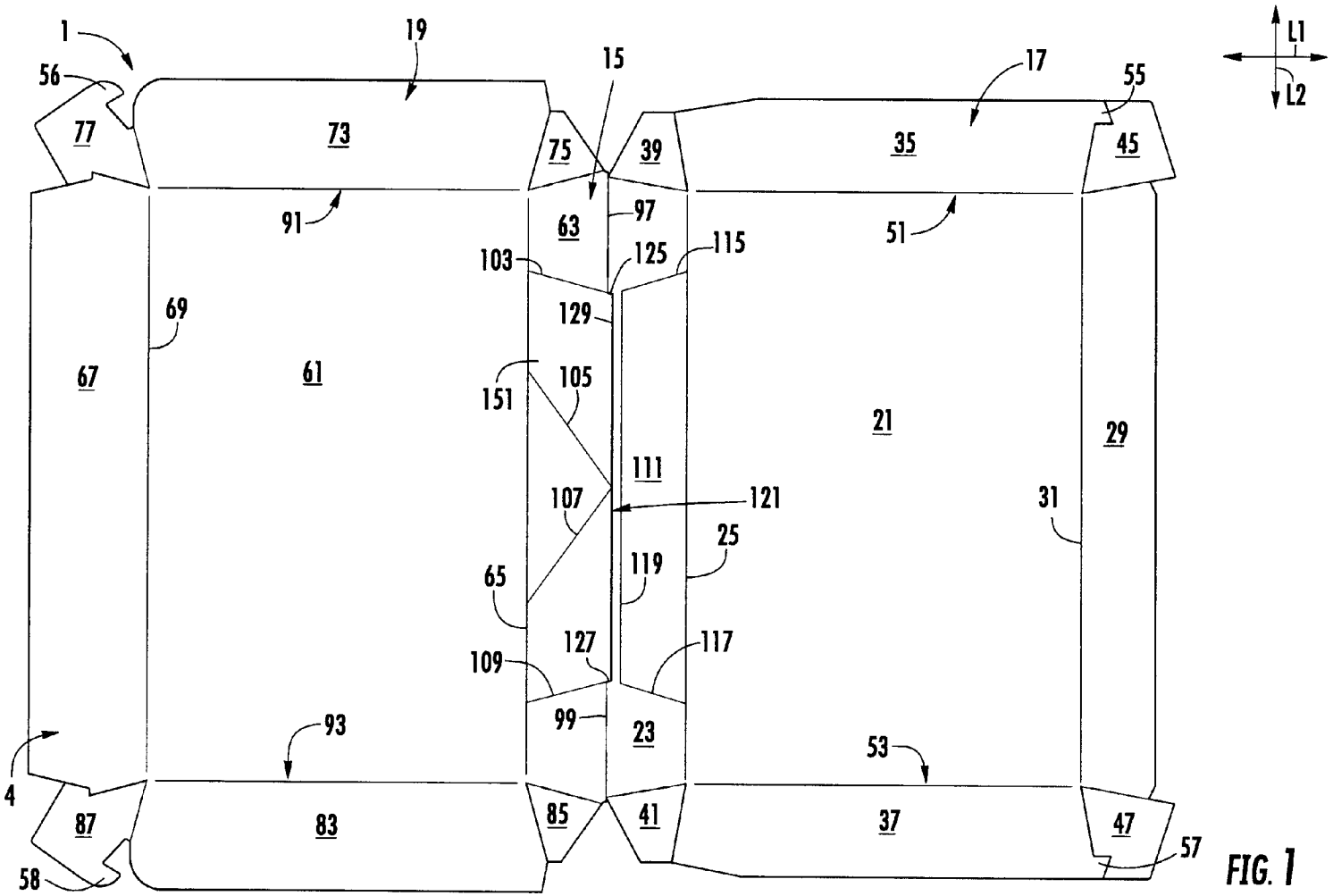
FIG. 1 is an exterior plan view of a blank for forming a carton according to a first embodiment of the disclosure.

FIG. 1 includes a plan view of a carton blank 1 used to form a carton 3 (FIGS. 2 and 3) of a first embodiment of the disclosure. FIG. 1 shows an exterior or printed side 4 of the blank 1. The carton 3 can be used to hold a food product (not shown), such as a fast-food item (e.g., sandwich, French fries, burrito, scrambled eggs, etc.). The carton 3 with food product can be placed in a microwave oven (not shown) to heat and/or cook the food products, or the fully cooked and/or heated food product can be placed in the carton for service to a customer for consumption. The carton 3 includes a tray 7 that is sized to hold the food product, and a lid 11 foldably connected to the tray 7 at a hinge 15. The hinge 15 has features to facilitate movement of the lid 11 between the closed position (FIG. 2) and the open position (FIG. 3), and vice versa.

The carton 3 may have an element (not shown) for use in cooking, heating, browning, and/or shielding (e.g., a microwave energy interactive element such as, but not limited to, a susceptor) mounted to one or more surfaces of the tray 7 and/or the lid 11. Alternatively, or in addition, the carton 3 can also include a window in one or more of the panels of the tray 7 and/or the lid 11. For example, a window could include an opening defined a top panel of the tray 7 and a transparent or translucent liner material covering the opening. It is understood that the microwave energy interactive elements or features and the window may be omitted from the carton 3 without departing from the disclosure. In this specification, the terms "lower," "bottom," "upper," and "top" indicate orientations determined in relation to fully erected and upright packages.

As shown in FIG. 1, the carton blank 1 has a longitudinal axis L1 and a lateral axis L2. The blank 1 includes a first or tray portion 17 for forming the tray 7 and a second or lid portion 19 for forming the lid 11. The tray portion 17 includes a bottom panel 21 foldably connected to a first side panel 23 at a lateral fold line 25. A second side panel 29 is foldably connected to the bottom panel 21 at a lateral fold line 31. In the illustrated embodiment, the bottom panel 21 includes two end flaps 35, 37 foldably connected to opposite ends of the bottom panel 21. The first side panel 23 has two end flaps 39, 41 foldably connected to opposite ends of the first side panel. The second side panel 29 has two end flaps 45, 47 foldably connected to opposite ends of the second side panel. In the illustrated embodiment, the end flaps 35, 37 include locking projections 55, 57.

The end flaps 35, 39, 45 extend along a first marginal area of the tray portion 17 and are foldably connected at a first longitudinal fold line 51. The end flaps 37, 41, 47 extend along a second marginal area of the tray portion 17, and are foldably connected at a second longitudinal fold line 53. The longitudinal fold lines 51, 53 may be, for example, substantially straight, or offset at one or more locations to account for blank thickness or for other factors. Additionally, the ends of the longitudinal fold lines 51, 53 can be at least slightly oblique to help in positioning the sides and ends of the carton 3 to be oblique with respect to the top and bottom of the carton. The features that form the tray portion 17 and the tray 7 could be otherwise shaped, arranged, configured, and/or omitted without departing from the disclosure.

Figure 2:
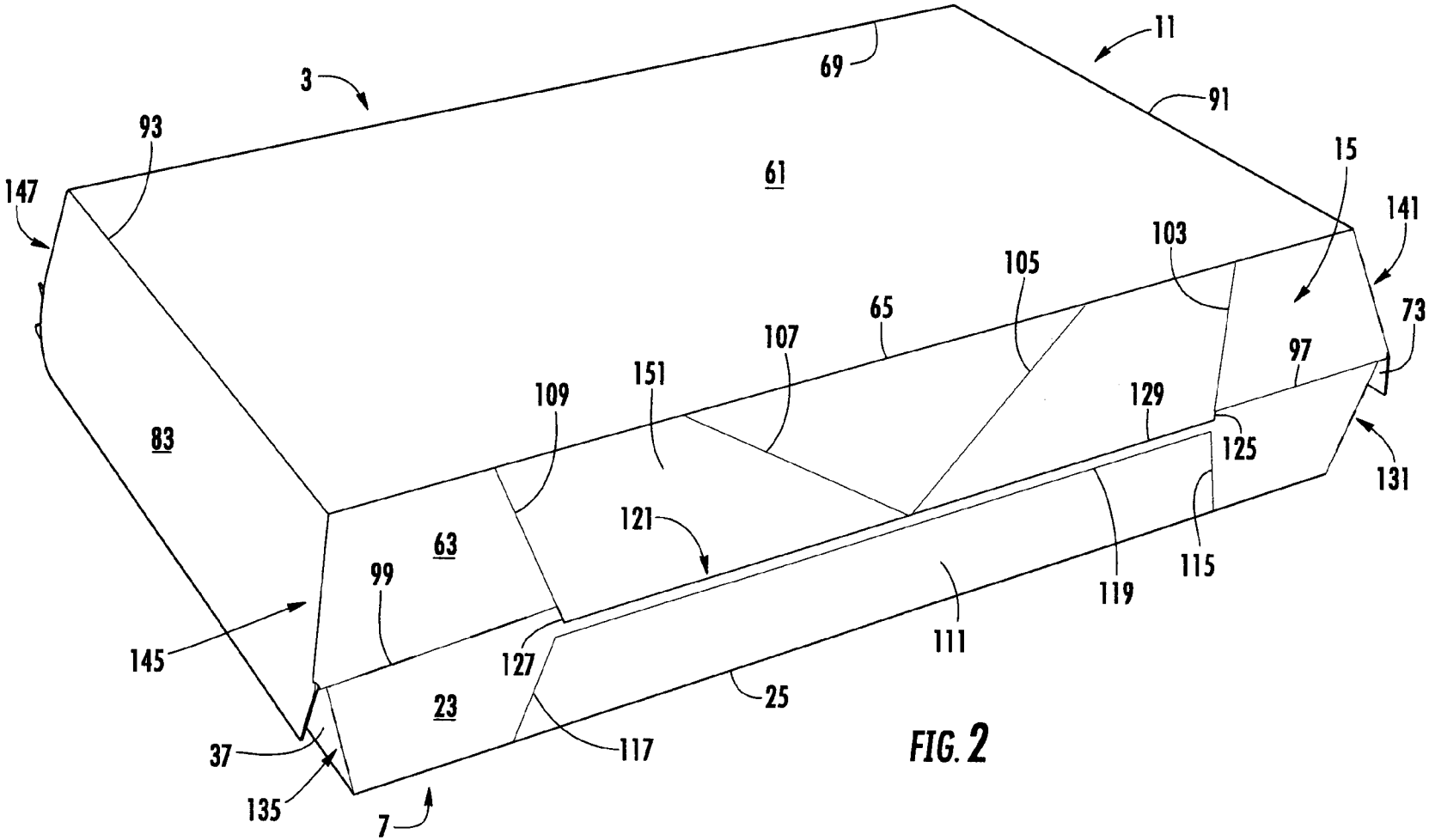
FIG. 2 is a perspective view of the carton in a closed configuration according to the first embodiment of the disclosure.
Figure 3:
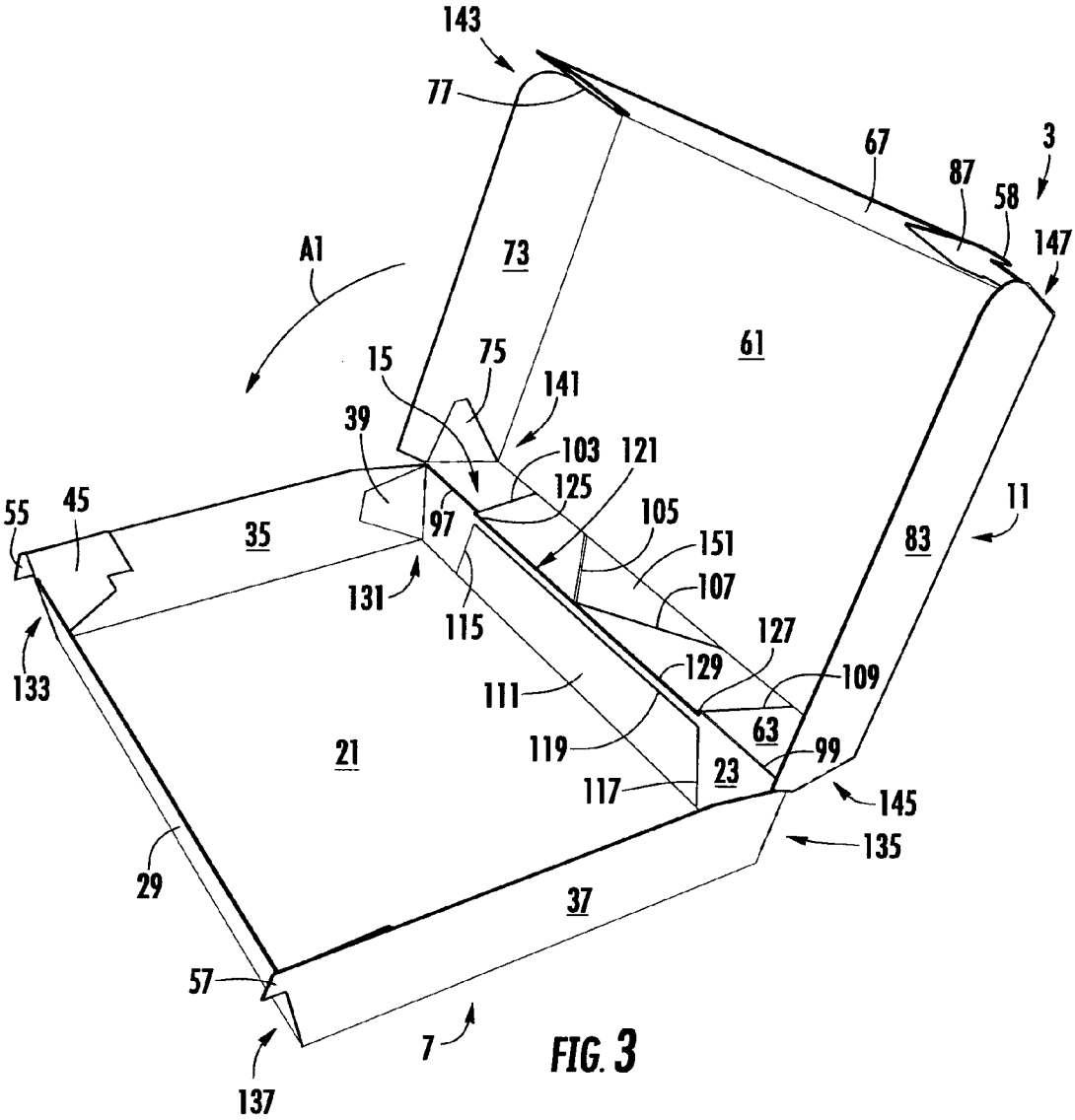
FIG. 3 is a perspective view of the carton in an open configuration according to the first embodiment of the disclosure.

In the illustrated embodiment, the lid portion 19 is shaped generally similar to the tray portion 17 and includes a top panel 61 foldably connected to a first side panel 63 at a lateral fold line 65 and a second side panel 67 at a lateral fold line 69. The top panel 61 includes two end panels 73, 83 foldably connected to opposite ends of the top panel 61. The first side panel 63 has two end flaps 75, 85 foldably connected to opposite ends of the first side panel. The end panels 73, 83 include respective end flaps 77, 87 foldably connected to the respective end panels 73, 83 adjacent opposite ends of the second side panel 67. In the illustrated embodiment, the end flaps 77, 87 include locking projections 56, 58 for engaging the respective locking projections 55, 57 in the tray 7 when the carton 3 is in the closed configuration (FIG. 2).

The end panel 73 and the end flaps 75, 77 extend along a first marginal area of the lid portion 19. The end panel 83 and the end flaps 85, 87 extend along a second marginal area of the lid portion 19. The end panels 73, 83 are foldably connected to the top panel 61 at a respective first longitudinal fold line 91 and second longitudinal fold line 93. The end flaps 75, 85 are foldably connected to the first side panel 63 at respective ends of the respective first longitudinal fold line 91 and second longitudinal fold line 93. The end flaps 77, 87 are foldably connected to the respective end panels 73, 83 along respective ends of the lateral fold line 69. As with the tray portion 17, the longitudinal fold lines 91, 93 can have portions that are offset, oblique, and/or spaced apart from other portions of the fold line. The features that form the lid portion 19 and the lid 11 could be otherwise shaped, arranged, configured, and/or omitted without departing from the disclosure.

As shown in FIG. 1, the features that form the hinge 15 extend in or between the side panel 23 (e.g., tray hinge side panel 23) and the side panel 63 (e.g., lid hinge side panel 63). The features that form the hinge 15 can include two spaced-apart, lateral hinge fold lines 97, 99 at respective ends of the hinge side panels 23, 63. The hinge fold lines 97, 99 foldably connect respective portions of the tray hinge side panel 23 of the tray portion 17 to respective portions of the lid hinge side panel 63 of the lid portion 19. The features that form the hinge 15 can include a cut 121 that extends generally between the hinge fold lines 97, 99, oblique fold lines or creases 103, 105, 107, 109 in the lid hinge side panel 63, and oblique fold lines or creases 115, 117 and a lateral fold line or crease 119 in the tray hinge side panel 23. The tray hinge side panel 23 can include a debossed portion 111 that is at least partially defined by the oblique creases 115, 117 and the lateral crease 119, which extends between respective ends of the oblique creases 115, 117. The debossed portion 111 is pressed inwardly from the exterior surface 4 of the blank 1. In one embodiment, the portion of the side panel 63 defined by the oblique fold lines 103, 109 and the cut 121 can be an embossed portion 151 of the hinge 15. The embossed portion 151 can be pressed outwardly relative to the remaining portions of the side panel 63.

Figure 1A:
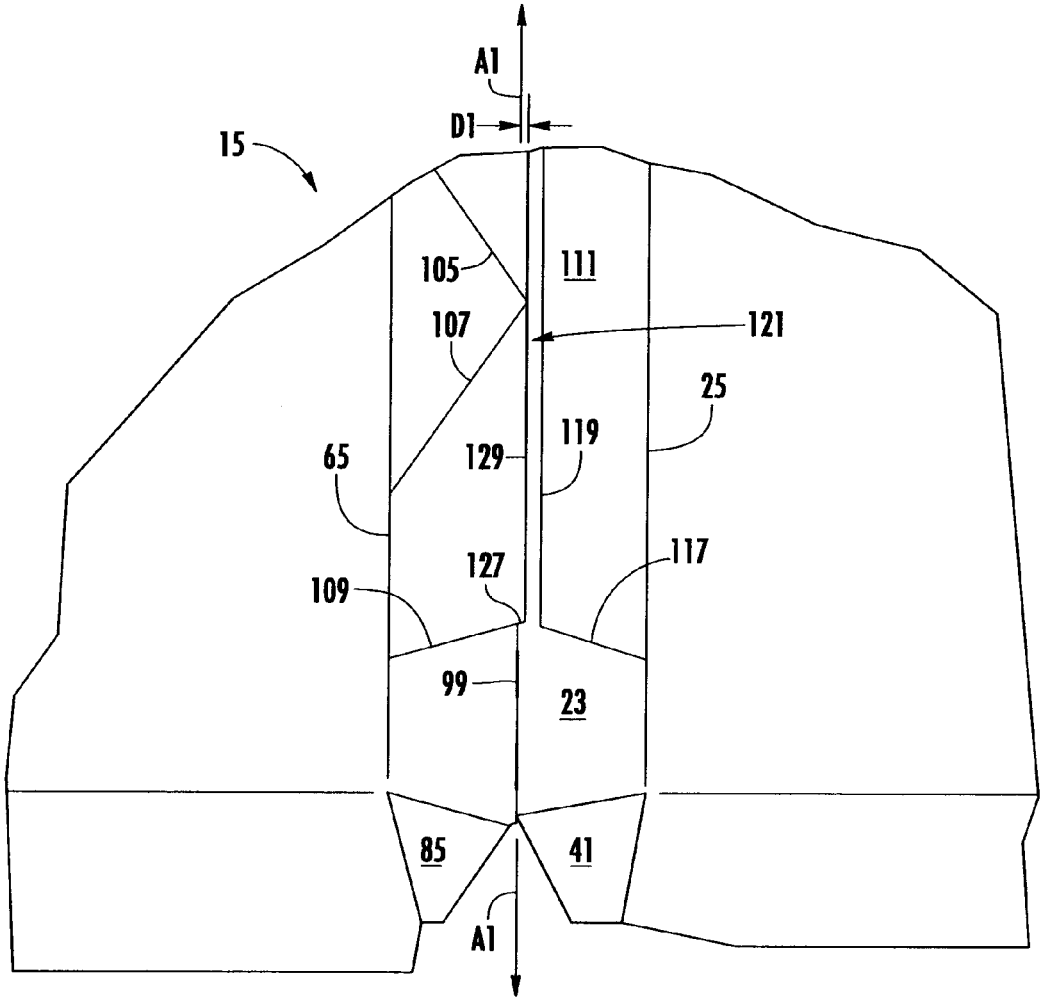
FIG. 1A is a detail view of a portion of the blank of FIG. 1.

As shown in FIGS. 1 and 1A, the cut 121 can include two short, oblique end portions 125, 127 extending from respective ends of a lateral central portion 129 of the cut 121. The end portion 125 can extend from a junction of the oblique fold line 103 and the hinge fold line 97, and the end portion 127 can extend from a junction of the oblique fold line 109 and the hinge fold line 99. In the illustrated embodiment, the hinge fold lines 97, 99 are generally aligned with a hinge axis A1, and the central portion 129 is spaced apart from and generally parallel to the hinge axis A1 and the hinge fold lines 97, 99. The central portion 129 can be spaced apart from the hinge axis A1 by a distance D1 (FIG. 1A), which, according to one exemplary embodiment, can be approximately 1/16 to 1/8 of an inch. The central portion 129 also can be spaced apart from and generally parallel with the lateral crease 119 forming the debossed portion 111. In one exemplary embodiment, the lateral portion 129 of the cut 121 is spaced apart from the lateral fold line 119 by approximately ⅛ of an inch. The central portion 129 of the cut 121 and/or the lateral fold line 119 could be otherwise located without departing from the disclosure.

As shown in FIG. 1, the oblique creases 105, 107 can extend from a midpoint of the central portion 129 of the cut 121 to the lateral fold line 65, and the oblique creases 103, 109 can extend from the respective end portions 125, 127 of the cut 121 to the lateral fold line 65. The oblique creases 103, 105, 107, 109 can help reinforce the lid hinge side panel 63. Similarly, the oblique creases 115, 117 and the lateral crease 119 can help reinforce the tray hinge side panel 23. The blank 1 could have other features for forming the hinge 15 or the features shown could be otherwise shaped, arranged, configured, and/or omitted without departing from the disclosure.

In one exemplary embodiment, the carton 3 is formed by forming the tray portion 17 of the blank 1 into the tray 7 and forming the lid portion 19 of the blank into the lid 11. In one exemplary method, the tray 7 is formed by folding the side panels 23, 29 and the end flaps 35, 37 relative to the bottom panel 21. The end flaps 39, 45 are inwardly folded and overlapped with the end flap 35 to form respective reinforced corners 131, 133 of the tray 7. The end flaps 41, 47 are overlapped with the end flap 37 to form respective reinforced corners 135, 137 of the tray 7. In one embodiment, the end flaps can be glued to the respective end flaps 35, 37. The tray 7 could be formed by other forming steps without departing from the disclosure.

The lid 11 is formed in a similar manner as the tray 7. In one exemplary method, the lid 11 is formed by folding the side panels 63, 67 and the end panels 73, 83 relative to the top panel 61. The end flaps 75, 85 are inwardly folded and overlapped with the respective end panels 73, 83 to form respective reinforced corners 141, 145 of the lid 11. The end flaps 77, 87 are inwardly folded and overlapped with the side panel 67 to form respective reinforced corners 143, 147 of the lid 11. The lid 11 could be formed by other forming steps without departing from the disclosure.

A food product or other product can be placed on the bottom wall 21 of the tray 7 and the lid 11 can be folded in the direction of arrow A1 (FIG. 3) to close the carton 3 (FIG. 2). The locking features 55, 57 can engage the respective locking features 56, 58 when the carton 3 is in the closed configuration to help retain the carton in the closed configuration. The hinge 15 is configured to prevent buckling of the material in the side panels 23, 63 and to facilitate movement of the lid 11 from the open position (FIG. 3) to the closed position (FIG. 2) and from the closed position to the open position. As the lid 11 is folded relative to the tray 7, the lid hinge side panel 63 pivots relative to the tray hinge side panel 23 along the hinge fold lines 97, 99. In the illustrated embodiment, the cut 121 forms a protrusion extending from the lid hinge side panel 63 and a corresponding recess in the edge of the tray hinge side panel 23. As the lid hinge side panel 63 pivots relative to the tray hinge side panel 23, the protrusion can pivot past the recess, which provides room to help reduce interference between the side panels 23, 63. Accordingly, the cut 121 can help reduce buckling of the side panels 23, 63. The debossed portion 111 of the side panel 23 is pressed inwardly relative to the rest of the side panel 23 and helps to further offset the respective edges of the side panels 23, 63 formed at the lateral portion 129 of the cut 121 and reduce or eliminate any interference that may otherwise occur between the hinge side panels when the lid 11 is moved relative to the tray 7. Additionally, the embossed portion 151 of the lid 7 can be pressed outwardly relative to the remaining portions of the side panel 63 to further enhance the nonbinding or anti-buckling features of the hinge 15. The hinge 15 and the carton 3 could be otherwise shaped, arranged, and/or configured without departing from the disclosure.

Figure 4:
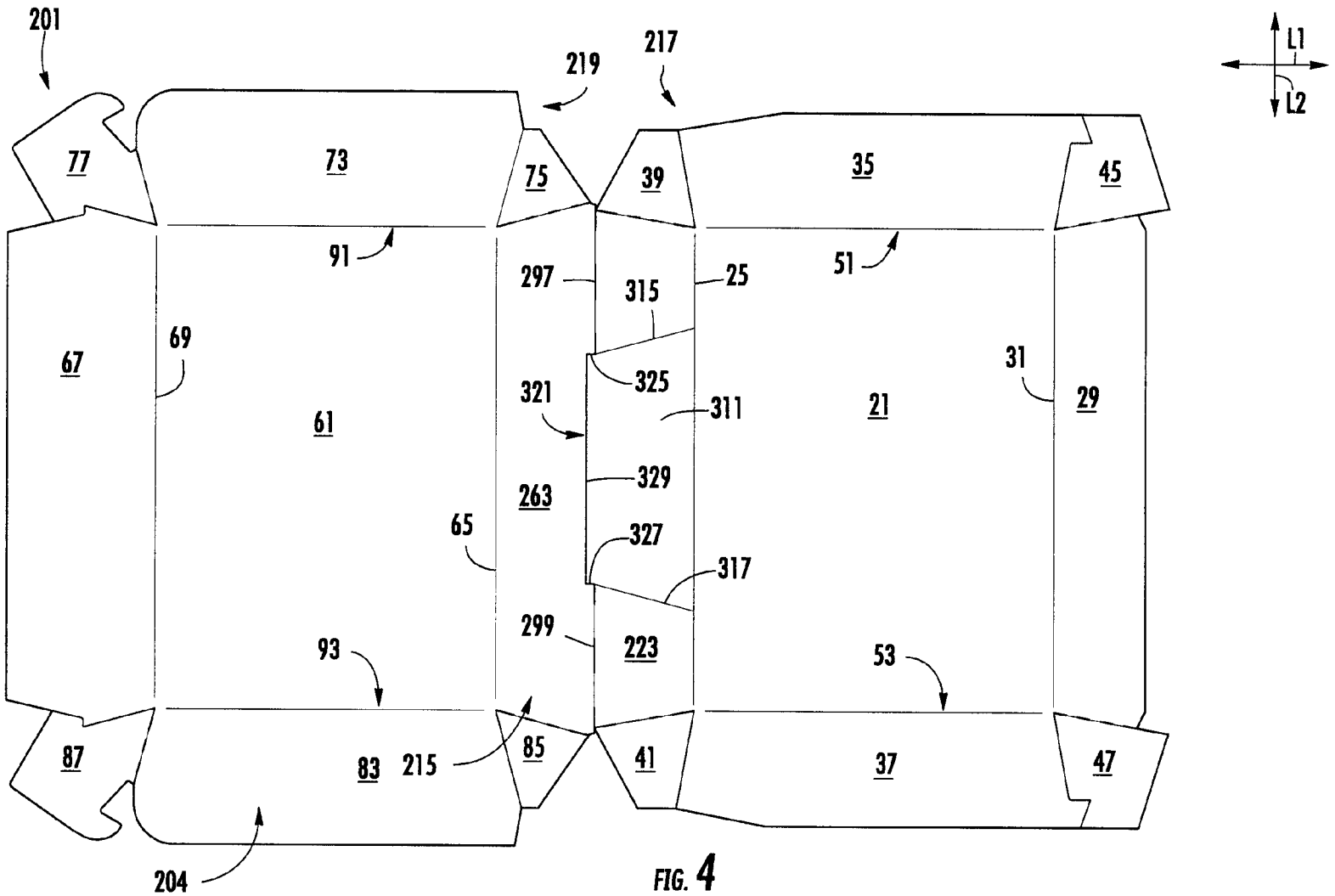
FIG. 4 is an exterior plan view of a blank for forming a carton according to a second embodiment of the disclosure.
Figure 4A:
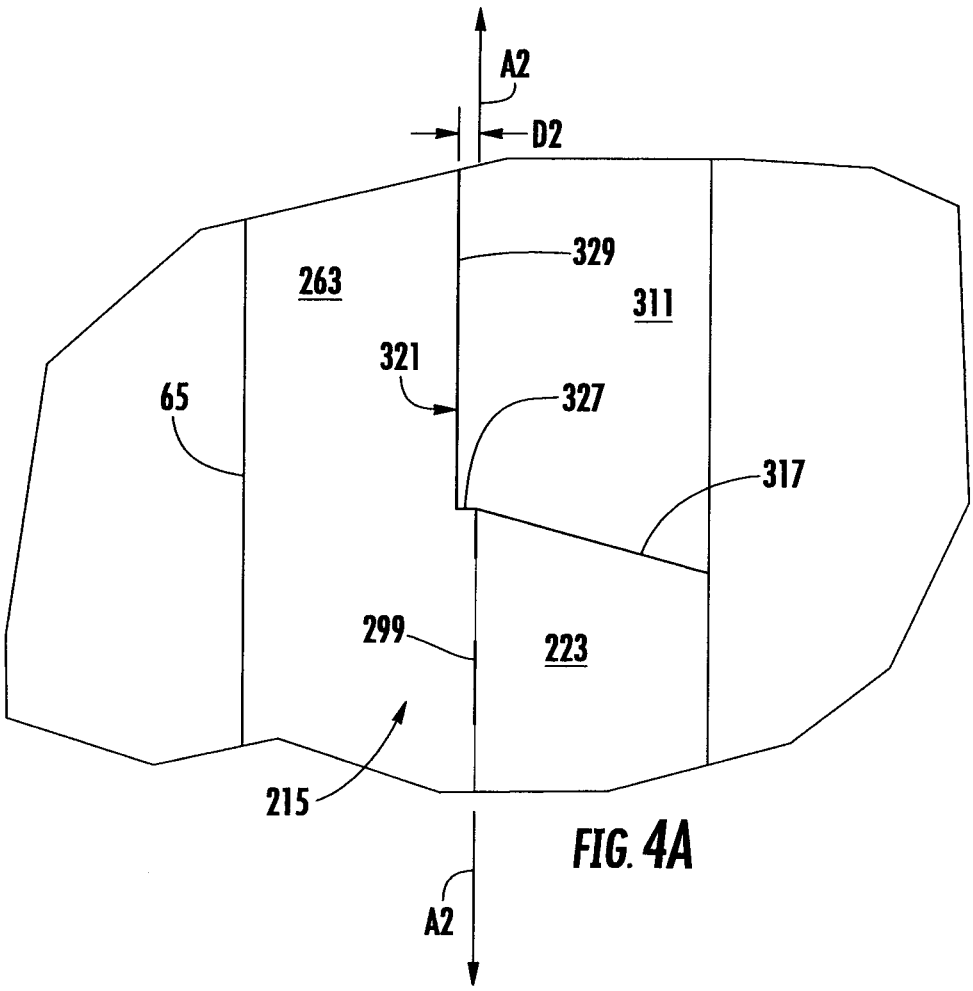
FIG. 4A is a detail view of a portion of the blank of FIG. 4.
Figure 5:
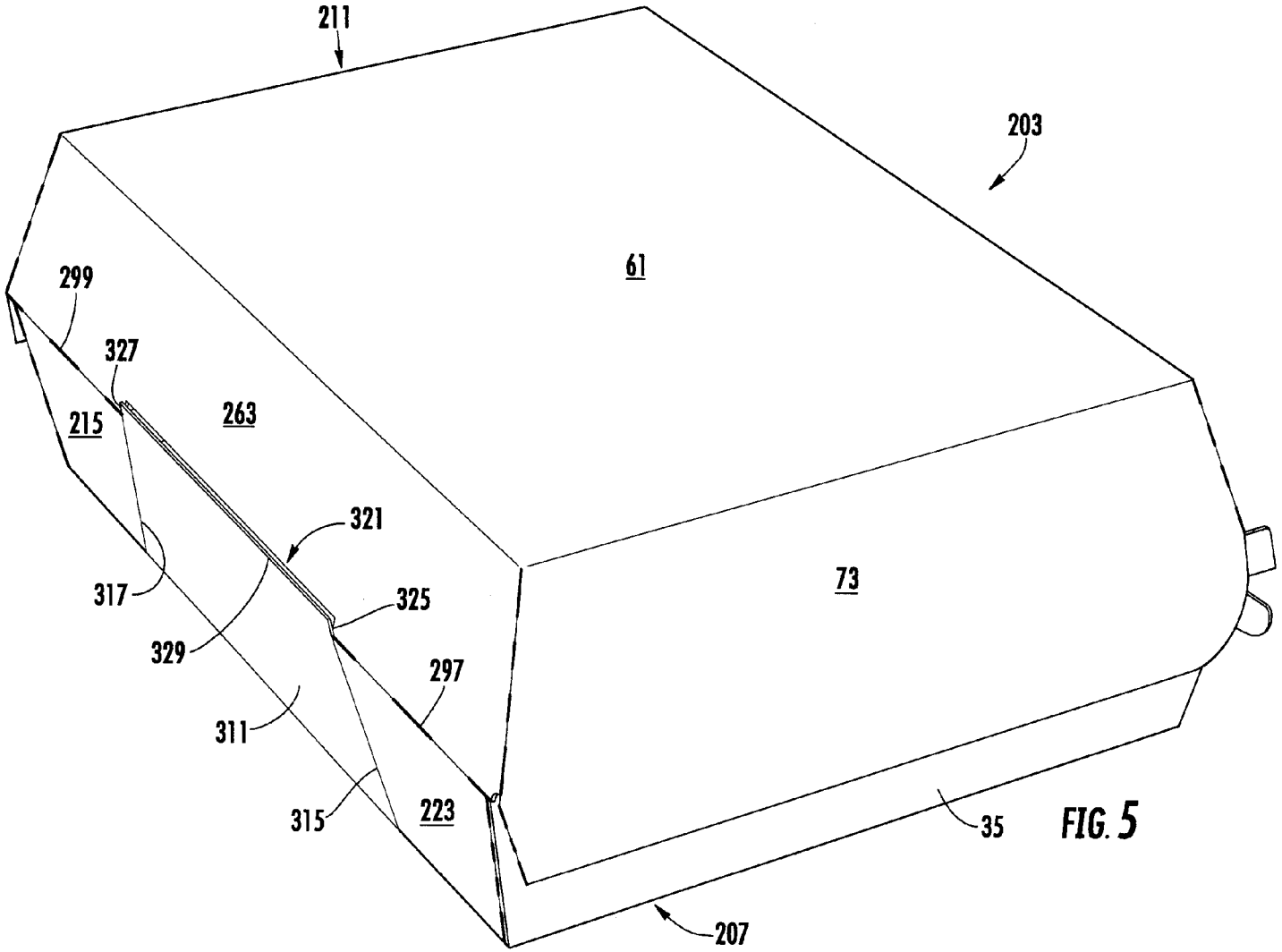
FIG. 5 is a perspective view of the carton in a closed configuration according to the second embodiment of the disclosure.
Figure 6:
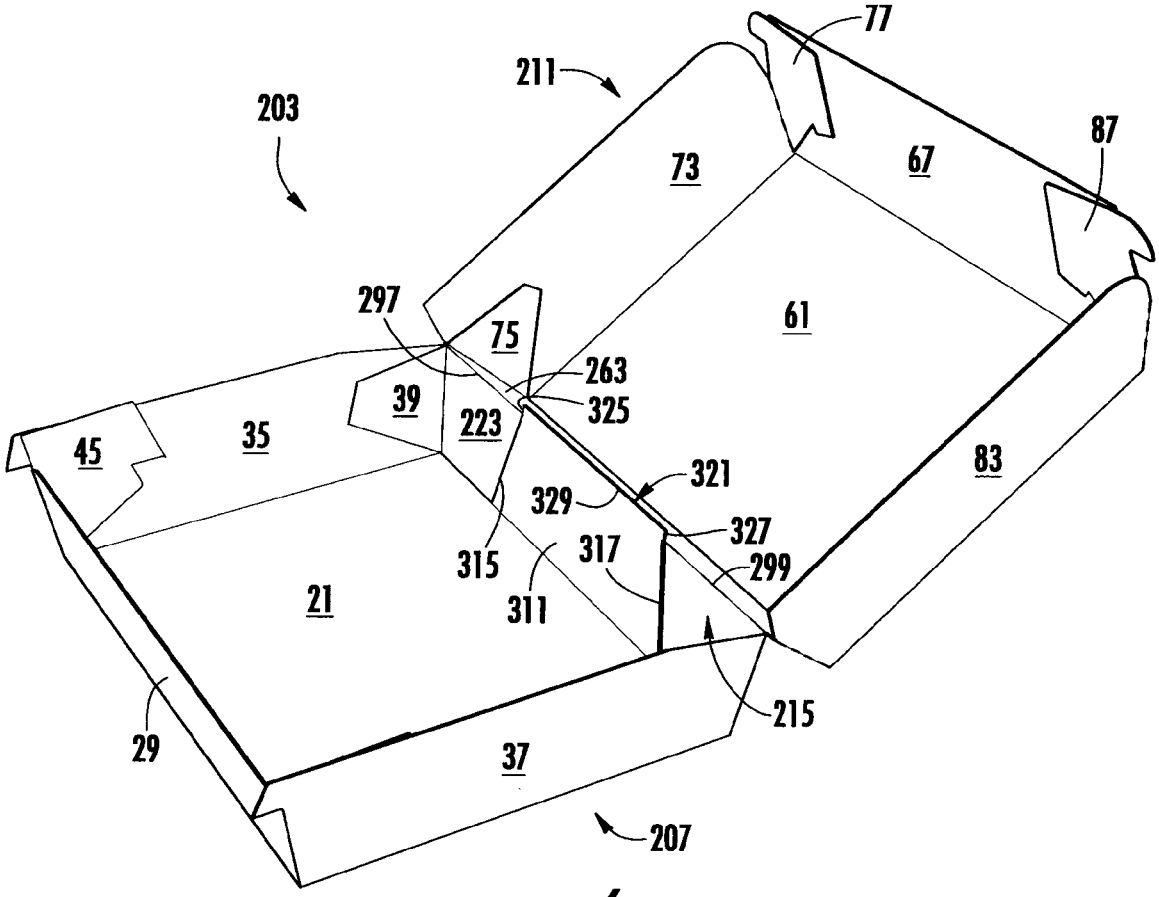
FIG. 6 is a perspective view of the carton in an open configuration according to the second embodiment of the disclosure.

FIGS. 4-6 illustrate a blank 201 and carton 203 according to a second embodiment similar to the carton 3 and blank 1 of the first embodiment. Accordingly, like or similar features are indicated with like or similar reference numbers between the two embodiments. The second embodiment is generally similar to the first embodiment, except for variations noted and variations that will be apparent to one of ordinary skill in the art. The carton 203 has a tray 207, a lid 211, and a hinge 215 that foldably connects the lid and the tray. The hinge 215 is formed from features in the blank 201 including lateral hinge fold lines 297, 299 that foldably connect respective hinge side panels 223, 263 of the tray portion 217 and the lid portion 219 of the blank 201. The hinge fold lines 297, 299 can be generally aligned with a hinge axis A2 (FIG. 4A). As shown in FIGS. 4 and 4A, the hinge 215 includes a cut 321 extending between the hinge fold lines 297, 299. The cut 321 can include two end portions 325, 327 and a lateral central portion 329 extending between the end portions 325, 327. The end portion 325 can extend from a junction of the oblique crease 315 and the hinge fold line 297, and the end portion 327 can extend from a junction of the oblique crease 317 and the hinge fold line 299. The central portion 329 of the cut 321 can be generally parallel to and offset from the hinge axis A2 (FIG. 4A). The central portion 329 can be spaced apart from the hinge axis A2 by a distance D2 (FIG. 4A), which, according to one exemplary embodiment, can be approximately 1/16 to ⅛ of an inch. The cut line 321 and the axis A2 could be otherwise shaped, arranged, configured and/or omitted without departing from the scope of the disclosure.

In the embodiment of FIGS. 4-6, the side panel 223 of the tray portion 217 has a debossed area 311 that is pressed inwardly from the exterior surface 204 of the blank 201. The debossed area 311 is defined by the oblique creases 315, 317 in the tray hinge side panel 223 and the cut 321. The creases 315, 317 can help reinforce the tray hinge side panel 223. The hinge 215 could be otherwise shaped, arranged, and/or configured without departing from the scope of the disclosure.

The hinge 215 functions in a similar manner as the hinge 15 of the first embodiment. The cut 321 forms a protrusion extending from the tray hinge side panel 223 and a corresponding recess in the edge of the lid hinge side panel 263. As the lid hinge side panel 263 pivots relative to the tray hinge side panel 223, the recess can pivot past the protrusion, and the recess provides room to help reduce interference between the side panels 223, 263. The debossed area 311 is pressed inwardly from the remaining portions of the side panel 223 so that the edge of the side panel 223 formed at the cut line 321 is offset from the edge of the side panel 263 formed at the cut line 321. In this manner, the hinge 215 facilitates movement of the lid 211 while helping to reduce or eliminate buckling or interference of the material in the side panels 223, 263.

The blanks according to the present disclosure can be, for example, formed from coated paperboard and similar materials. For example, the interior and/or exterior sides of the blank can be coated with a clay coating. The clay coating may then be printed over with product, advertising, price coding, and other information or images. The blank may then be coated with a varnish to protect any information printed on the blank. The blank may also be coated with, for example, a moisture barrier layer, on either or both sides of the blank. In accordance with the above-described embodiments, the blank may be constructed of paperboard of a caliper such that it is heavier and more rigid than ordinary paper. The blank can also be constructed of other materials, such as cardboard, hard paper, or any other material having properties suitable for enabling the carton to function at least generally as described herein. The blank can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines may include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, cut line, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives used to secure carton panels in place such as heat sealing, or any other manner than may or may not include glue, adhesive, or other bonding agent.

The foregoing description illustrates and describes various embodiments of the present disclosure. As various changes could be made in the above construction, it is intended that all matter contained in the above description or shown in the accompanying drawings shall be interpreted as illustrative and not in a limiting sense. It will be understood by those skilled in the art that while the present disclosure has been discussed above with reference to exemplary embodiments, various additions, modifications and changes can be made thereto without departing from the spirit and scope of the disclosure.

What is claimed is:

1. A carton for holding a product, the carton comprising:

a tray comprising a plurality of tray panels that extend at least partially around an interior of the tray, the plurality of tray panels comprising a bottom panel and at least one tray side panel foldably connected to the bottom panel, the at least one tray side panel comprising a tray hinge side panel;

a lid comprising a plurality of lid panels that extend at least partially around an interior of the lid, the plurality of lid panels comprising a top panel and at least one lid side panel foldably connected to the top panel, the at least one lid side panel comprising a lid hinge side panel, the lid cooperating with the tray to at least partially close the carton when the carton is configured in a closed position; and a hinge at least partially foldably connecting the lid and the tray, the hinge comprising a first hinge fold line, a second hinge fold line, and a cut extending between the first hinge fold line and the second hinge fold line, the first hinge fold line and the second hinge fold line being generally aligned along a hinge axis, and the cut comprising a central portion that is generally parallel to the hinge axis and is offset from the hinge axis, wherein a first portion of the tray hinge side panel is foldably connected to a first portion of the lid hinge side panel along the first hinge fold line, and a second portion of the tray hinge side panel is foldably connected to a second portion of the lid hinge side panel along the second hinge fold line, the cut further comprises a first end portion and a second end portion, the first end portion extending from the first hinge fold line to a first end of the central portion, and the second end portion extending from the second hinge fold line to a second end of the central portion, the central portion of the cut is offset from the hinge axis toward the bottom panel, the hinge further comprises at least one crease line extending in the lid hinge side panel, the at least one crease line extending from an end of at least one of the first end portion of the cut and the second end portion of the cut and from an end of at least one of the first hinge fold line and the second hinge fold line; and the hinge further comprises a debossed portion extending in the tray hinge side panel, the debossed portion being spaced apart from the cut.

2. The carton of claim 1, wherein the hinge further comprises a first plurality of crease lines extending in the lid hinge side panel and a second plurality of crease lines extending in the tray hinge side panel, the first plurality of crease lines comprising a first oblique crease line and a second oblique crease line, the first oblique crease line being generally collinear with the first end portion of the cut, and the second oblique crease line being generally collinear with the second end portion of the cut, the first oblique crease line and the second oblique crease line extending from respective ends of the respective first hinge fold line and second hinge fold line.

3. The carton of claim 2, wherein the first plurality of crease lines comprises a third oblique crease line and a fourth oblique crease line, each of the third oblique crease line and the fourth oblique crease line extending from a midpoint of the central portion of the cut.

4. The carton of claim 2, wherein the hinge further comprises an embossed portion in the lid hinge side panel, the embossed portion being at least partially defined by the cut, the first oblique crease line, and the second oblique crease line.

5. The carton of claim 4, wherein:

the second plurality of crease lines comprises a lateral crease line extending between respective ends of two oblique crease lines, the lateral crease line being spaced apart from the central portion of the cut; and the hinge further comprises a debossed portion in the tray hinge side panel, the debossed portion being at least partially defined by the plurality of second crease lines.

6. The carton of claim 1, wherein at least a portion of the tray hinge side panel is separated from at least a portion of the lid hinge side panel along the cut, and the cut at least partially defines a protrusion extending from a first one of the tray hinge side panel and the lid hinge side panel and a recess in an edge of a second one of the tray hinge side panel and the lid hinge side panel.

7. The carton of claim 6, wherein the hinge further comprises at least one bossed portion extending in at least one of the tray hinge side panel and the lid hinge side panel.

8. A carton for holding a product, the carton comprising:

a tray comprising a plurality of tray panels that extend at least partially around an interior of the tray, the plurality of tray panels comprising a bottom panel and at least one tray side panel foldably connected to the bottom panel, the at least one tray side panel comprising a tray hinge side panel;

a lid comprising a plurality of lid panels that extend at least partially around an interior of the lid, the plurality of lid panels comprising a top panel and at least one lid side panel foldably connected to the top panel, the at least one lid side panel comprising a lid hinge side panel, the lid cooperating with the tray to at least partially close the carton when the carton is configured in a closed position; and a hinge at least partially foldably connecting the lid and the tray, the hinge comprising a first hinge fold line, a second hinge fold line, and a cut extending between the first hinge fold line and the second hinge fold line, the first hinge fold line and the second hinge fold line being generally aligned along a hinge axis, and the cut comprising a central portion that is generally parallel to the hinge axis and is offset from the hinge axis, wherein a first portion of the tray hinge side panel is foldably connected to a first portion of the lid hinge side panel along the first hinge fold line, and a second portion of the tray hinge side panel is foldably connected to a second portion of the lid hinge side panel along the second hinge fold line, the cut further comprises a first end portion and a second end portion, the first end portion extending from the first hinge fold line to a first end of the central portion, and the second end portion extending from the second hinge fold line to a second end of the central portion, the central portion of the cut is offset from the hinge axis toward the top panel, the hinge further comprises at least one crease line extending in the tray hinge side panel, the at least one crease line extending from an end of at least one of the first end portion of the cut and the second end portion of the cut and from the end of at least one of the first hinge fold line and the second hinge fold line; and the hinge further comprises a debossed portion extending in the tray hinge side panel, the debossed portion being at least partially defined by the at least one crease line and the cut.

9. A carton for holding a product, the carton comprising:

a tray comprising a plurality of tray panels that extend at least partially around an interior of the tray, the plurality of tray panels comprising a bottom panel and at least one tray side panel foldably connected to the bottom panel, the at least one tray side panel comprising a tray hinge side panel;

a lid comprising a plurality of lid panels that extend at least partially around an interior of the lid, the plurality of lid panels comprising a top panel and at least one lid side panel foldably connected to the top panel, the at least one lid side panel comprising a lid hinge side panel, the lid cooperating with the tray to at least partially close the carton when the carton is configured in a closed position; and a hinge at least partially foldably connecting the lid and the tray, the hinge comprising a first hinge fold line, a second hinge fold line, and a cut extending between the first hinge fold line and the second hinge fold line, the first hinge fold line and the second hinge fold line being generally aligned along a hinge axis, and the cut comprising a central portion that is generally parallel to the hinge axis and is offset from the hinge axis, wherein a first portion of the tray hinge side panel is foldably connected to a first portion of the lid hinge side panel along the first hinge fold line, and a second portion of the tray hinge side panel is foldably connected to a second portion of the lid hinge side panel along the second hinge fold line, the cut further comprises a first end portion and a second end portion, the first end portion extending from the first hinge fold line to a first end of the central portion, and the second end portion extending from the second hinge fold line to a second end of the central portion, wherein the hinge further comprises a first crease line and a second crease line, each of the first crease line and the second crease line extending in the tray hinge side panel, the first crease line extending from an end of each of the first end portion of the cut and the first hinge fold line, and the second crease line extending from an end of each of the second end portion of the cut and the second hinge fold line.

10. The carton of claim 9, wherein the hinge further comprises a debossed portion, the debossed portion being at least partially defined by the first crease line, the second crease line, and the cut.

11. A blank for forming a carton for holding a product, the blank comprising:

a tray portion for forming a tray in the carton formed from the blank, the tray portion comprising a plurality of tray panels comprising a bottom panel and at least one tray side panel foldably connected to the bottom panel, the at least one tray side panel comprising a tray hinge side panel;

a lid portion for forming a lid in the carton formed from the blank, the lid portion comprising a plurality of lid panels comprising a top panel and at least one lid side panel foldably connected to the top panel, the at least one lid side panel comprising a lid hinge side panel; and hinge features for forming a hinge at least partially foldably connecting the lid and the tray in the carton formed from the blank, the hinge features comprising a first hinge fold line, a second hinge fold line, and a cut extending between the first hinge fold line and the second hinge fold line, the first hinge fold line and the second hinge fold line being generally aligned along a hinge axis, and the cut comprising a central portion that is generally parallel to the hinge axis and is offset from the hinge axis, wherein a first portion of the tray hinge side panel is foldably connected to a first portion of the lid hinge side panel along the first hinge fold line, and a second portion of the tray hinge side panel is foldably connected to a second portion of the lid hinge side panel along the second hinge fold line, the cut further comprises a first end portion and a second end portion, the first end portion extending from the first hinge fold line to a first end of the central portion, and the second end portion extending from the second hinge fold line to a second end of the central portion, the central portion of the cut is offset from the hinge axis toward the bottom panel, the hinge further comprises at least one crease line extending in the lid hinge side panel, the at least one crease line extending from an end of at least one of the first end portion of the cut and the second end portion of the cut and from the end of at least one of the first hinge fold line and the second hinge fold line; and the hinge further comprises a debossed portion extending in the tray hinge side panel, the debossed portion being spaced apart from the cut.

12. The blank of claim 11, wherein the hinge further comprises a first plurality of crease lines extending in the lid hinge side panel and a second plurality of crease lines extending in the tray hinge side panel, the first plurality of crease lines comprising a first oblique crease line and a second oblique crease line, the first oblique crease line being generally collinear with the first end portion of the cut, and the second oblique crease line being generally collinear with the second end portion of the cut, the first oblique crease line and the second oblique crease line extending from respective ends of the respective first hinge fold line and second hinge fold line.

13. The blank of claim 12, wherein the first plurality of crease lines comprises a third oblique crease line and a fourth oblique crease line, each of the third oblique crease line and the fourth oblique crease line extending from a midpoint of the central portion of the cut.

14. The blank of claim 12, wherein the hinge further comprises an embossed portion in the lid hinge side panel, the embossed portion being at least partially defined by the cut, the first oblique crease line, and the second oblique crease line.

15. The blank of claim 14, wherein:

the second plurality of crease lines comprises a lateral crease line extending between respective ends of two oblique crease lines, the lateral crease line being spaced apart from the central portion of the cut; and the hinge further comprises a debossed portion in the tray hinge side panel, the debossed portion being at least partially defined by the plurality of second crease lines.

16. The blank of claim 11, wherein the hinge further comprises a first crease line and a second crease line, each of the first crease line and the second crease line extending in the tray hinge side panel, the first crease line extending from an end of each of the first end portion of the cut and the first hinge fold line, and the second crease line extending from an end of each of the second end portion of the cut and the second hinge fold line.

17. The blank of claim 16, wherein the hinge further comprises a debossed portion, the debossed portion being at least partially defined by the first crease line, the second crease line, and the cut.

18. The blank of claim 11, wherein the hinge further comprises at least one bossed portion extending in at least one of the tray hinge side panel and the lid hinge side panel.

19. A blank for forming a carton for holding a product, the blank comprising:

a tray portion for forming a tray in the carton formed from the blank, the tray portion comprising a plurality of tray panels comprising a bottom panel and at least one tray side panel foldably connected to the bottom panel, the at least one tray side panel comprising a tray hinge side panel;

a lid portion for forming a lid in the carton formed from the blank, the lid portion comprising a plurality of lid panels comprising a top panel and at least one lid side panel foldably connected to the top panel, the at least one lid side panel comprising a lid hinge side panel; and hinge features for forming a hinge at least partially foldably connecting the lid and the tray in the carton formed from the blank, the hinge features comprising a first hinge fold line, a second hinge fold line, and a cut extending between the first hinge fold line and the second hinge fold line, the first hinge fold line and the second hinge fold line being generally aligned along a hinge axis, and the cut comprising a central portion that is generally parallel to the hinge axis and is offset from the hinge axis, wherein a first portion of the tray hinge side panel is foldably connected to a first portion of the lid hinge side panel along the first hinge fold line, and a second portion of the tray hinge side panel is foldably connected to a second portion of the lid hinge side panel along the second hinge fold line, the cut further comprises a first end portion and a second end portion, the first end portion extending from the first hinge fold line to a first end of the central portion, and the second end portion extending from the second hinge fold line to a second end of the central portion, the central portion of the cut is offset from the hinge axis toward the top panel, the hinge further comprises at least one crease line extending in the tray hinge side panel, the at least one crease line extending from an end of at least one of the first end portion of the cut and the second end portion of the cut and from the end of at least one of the first hinge fold line and the second hinge fold line; and the hinge further comprises a debossed portion extending in the tray hinge side panel, the debossed portion being at least partially defined by the at least one crease line and the cut.

20. A method of forming a carton, the method comprising:

obtaining a blank comprising a tray portion, a lid portion, and hinge features, the tray portion comprising a plurality of tray panels comprising a bottom panel and at least one tray side panel foldably connected to the bottom panel, the at least one tray side panel comprising a tray hinge side panel, the lid portion comprising a plurality of lid panels comprising a top panel and at least one lid side panel foldably connected to the top panel, the at least one lid side panel comprising a lid hinge side panel, and the hinge features comprising a first hinge fold line, a second hinge fold line, and a cut extending between the first hinge fold line and the second hinge fold line, wherein the first hinge fold line and the second hinge fold line are generally aligned along a hinge axis, the cut comprises a central portion that is generally parallel to the hinge axis and is offset from the hinge axis, a first portion of the tray hinge side panel is foldably connected to a first portion of the lid hinge side panel along the first hinge fold line, and a second portion of the tray hinge side panel is foldably connected to a second portion of the lid hinge side panel along the second hinge fold line, the cut further comprises a first end portion and a second end portion, the first end portion extending from the first hinge fold line to a first end of the central portion, and the second end portion extending from the second hinge fold line to a second end of the central portion, the hinge further comprises a first plurality of crease lines extending in the lid hinge side panel and a second plurality of crease lines extending in the tray hinge side panel, the first plurality of crease lines comprising a first oblique crease line and a second oblique crease line, the first oblique crease line being generally collinear with the first end portion of the cut, and the second oblique crease line being generally collinear with the second end portion of the cut, the first oblique crease line and the second oblique crease line extending from respective ends of the respective first hinge fold line and second hinge fold line;

forming an interior of a tray by folding the at least one tray side panel relative to the bottom panel;

forming an interior of a lid by folding the at least one lid side panel relative to the top panel, the lid being foldably connected to the tray at a hinge that comprises the hinge features; and positioning the lid and the tray between an open configuration and a closed configuration by folding the lid relative to the tray at the hinge.

21. A method of forming a carton, the method comprising:

obtaining a blank comprising a tray portion, a lid portion, and hinge features, the tray portion comprising a plurality of tray panels comprising a bottom panel and at least one tray side panel foldably connected to the bottom panel, the at least one tray side panel comprising a tray hinge side panel, the lid portion comprising a plurality of lid panels comprising a top panel and at least one lid side panel foldably connected to the top panel, the at least one lid side panel comprising a lid hinge side panel, and the hinge features comprising a first hinge fold line, a second hinge fold line, and a cut extending between the first hinge fold line and the second hinge fold line, wherein the first hinge fold line and the second hinge fold line are generally aligned along a hinge axis, the cut comprises a central portion that is generally parallel to the hinge axis and is offset from the hinge axis, a first portion of the tray hinge side panel is foldably connected to a first portion of the lid hinge side panel along the first hinge fold line, and a second portion of the tray hinge side panel is foldably connected to a second portion of the lid hinge side panel along the second hinge fold line, the cut further comprises a first end portion and a second end portion, the first end portion extending from the first hinge fold line to a first end of the central portion, and the second end portion extending from the second hinge fold line to a second end of the central portion, the hinge further comprises a first crease line and a second crease line, each of the first crease line and the second crease line extending in the tray hinge side panel, the first crease line extending from an end of each of the first end portion of the cut and the first hinge fold line, and the second crease line extending from an end of each of the second end portion of the cut and the second hinge fold line, and the hinge further comprises a debossed portion, the debossed portion being at least partially defined by the first crease line, the second crease line, and the cut;

forming an interior of a tray by folding the at least one tray side panel relative to the bottom panel;

forming an interior of a lid by folding the at least one lid side panel relative to the top panel, the lid being foldably connected to the tray at a hinge that comprises the hinge features; and positioning the lid and the tray between an open configuration and a closed configuration by folding the lid relative to the tray at the hinge.

* * * * *